US005645205A

United States Patent [19]

Kennedy

[11] Patent Number: 5,645,205

[45] Date of Patent: Jul. 8, 1997

[54] WATERPROOF SWIMMING POUCH

[76] Inventor: Linda Kennedy, P.O. Box 680398, Park City, Utah 84068

[21] Appl. No.: 183,918

[22] Filed: Jan. 19, 1994

Related U.S. Application Data

[63] Continuation of Ser. No. 803,128, Dec. 4, 1991.

[51] Int. Cl.[6] ..... A45F 3/00

[52] U.S. Cl. ..... 224/676; 224/664; 224/667; 224/669; 224/677; 224/934; 383/63; 383/111; 383/113; D3/221; D3/226; D3/230; D3/319

[58] Field of Search ..... 224/224, 226, 224/235, 240, 252, 253, 664, 667, 669, 676, 677, 934; 383/111, 113, 63, 901; D3/215, 221, 226, 230, 319

[56] References Cited

U.S. PATENT DOCUMENTS

| | | | |
|---|---|---|---|
| D. 261,196 | 10/1981 | Griffin . | |
| D. 265,149 | 6/1982 | Romano | D3/319 |
| D. 278,761 | 5/1985 | Fuller . | |
| D. 334,471 | 4/1993 | Yerby et al. | D3/226 |
| 1,559,270 | 10/1925 | Miller | 224/226 |
| 1,920,061 | 7/1933 | Carr | 224/235 X |
| 2,072,564 | 3/1937 | May | 383/111 X |
| 2,107,216 | 2/1938 | Rogers | 383/113 X |
| 3,485,281 | 12/1969 | Wicks | 383/111 X |
| 3,980,070 | 9/1976 | Krupa | 383/111 X |
| 4,420,097 | 12/1983 | Motsenbocker | 224/148 |
| 4,637,063 | 1/1987 | Sullivan et al. | 383/113 X |
| 4,871,597 | 10/1989 | Hobson . | |
| 4,905,857 | 3/1990 | Her . | |
| 4,951,666 | 8/1990 | Inman et al. | 383/901 X |
| 5,012,964 | 5/1991 | Falletta et al. | 224/153 |
| 5,060,835 | 10/1991 | Payne | 224/224 |
| 5,074,300 | 12/1991 | Murphy | 383/901 X |
| 5,096,103 | 3/1992 | Baugh | 224/151 |
| 5,114,061 | 5/1992 | Brady | 224/252 |
| 5,150,824 | 9/1992 | Alvarez et al. | 224/151 |

FOREIGN PATENT DOCUMENTS

| | | | |
|---|---|---|---|
| 1078797 | 6/1980 | Canada | 224/240 |
| 2522484 | 9/1983 | France | D3/226 |
| 2590458 | 5/1987 | France | 224/153 |

OTHER PUBLICATIONS

Fanny Pack and Insulated Container, Bass Pro Shops Catalog, 1990, p. 356.

Various Fanny Packs, Bow Hunters Catalog, Spring, 1986, p. 66.

Fanny Pack PB–9, M.G.B. Industral Co., Ltd. Advertisement, Hong Kong Enterprise Magazine, Oct., 1989, p. 485.

*Primary Examiner*—Stephen Croinin

*Attorney, Agent, or Firm*—John F. A. Earley; John F. A. Earley, III

[57] ABSTRACT

A pouch, consisting of an enclosure 8, a resealable inner waterproof pouch 25, a detachable strap 18 to be tied around the waist of the user.

6 Claims, 2 Drawing Sheets

WATERPROOF SWIMMING POUCH

This is a continuation of copending application Ser. No. 07/803,128 filed on Dec. 4, 1991.

BACKGROUND OF THE INVENTION

1. Field of Invention

The present invention relates to a comfortable and safe way to carry personal belongings in a nonbreakable waterproof swimming pouch, enabling its users to enjoy all water activities available by allowing them to give their undivided attention to their surroundings, without the fear that usually comes with the possible theft of one's cash, watch, credit cards, and wallet when left unattended on land, and at the same time enabling its users to feel attractive while wearing the aesthetically appealing waterproof pouch with swim wear.

2. Description of Prior Art

Water sports for the water sports enthusiast are usually performed with one eye on the beach watching the personal items that have been stored on the beach in a towel, hidden in the sand or a sneaker, unless one is fortunate enough to have a friend offer to give up their fun and stay behind and act as a watch guard. Many vacationing couples split water time because there is not a lightweight, safe, convenient, shatterproof, as well as aesthetically appealing, means to carry their personal items along with them.

While a diving box may exist, Her U.S. Pat. No. 4,905,857, it will hardly be the choice of the casual swimmer or water sports enthusiast. Who would choose a cumbersome, expensive, breakable and therefore unsafe and hazardous, means to carry personal items around one's waist while actually engaging in a sport where only fun is on the mind? In addition, the diving box is strictly functional, whereas the waterproof swimming pouch is a pleasure to the eye since said waterproof swimming pouch is made in coordinating colors and patterns to swim wear, rests lightly and comfortably on the hip, almost undetected by the wearer, and acts as part of the swimming dress.

SUMMARY OF THE INVENTION

The present invention was developed out of a need to provide a means for safe keeping the personal belongings of the water sports enthusiasts. The invention fulfills this need, and, at the same time, remains aesthetically appealing.

The waterproof swimming pouch is provided with an outer enclosure made of a lightweight, colored, patterned, and coordinated material such as nylon, cotton, polyester, or other known fabric materials. The enclosure material can be chosen to match all bathing apparel.

The waterproof swimming pouch is also provided with a resealable removable inner pouch liner that serves to waterproof the personal belongings of the sports enthusiast. Said inner pouch liner is made of durable waterproof material and shaped to fit the outer enclosure, and is provided with a resealable interlocking closure at the top of the inner pouch liner. Inner pouch will supply the means of water proof.

OBJECTS AND ADVANTAGES

Several objects and advantages of my invention are:

(a) to provide safety for personal belongings in a fashionable enclosure;

(b) to provide a lightweight enclosure;

(c) to provide a non-breakable enclosure.

Further objects and advantages are to provide an enclosure which can be used easily to open and reseal, which is simple to use and inexpensive to manufacture. Still further objects and advantages will become apparent from a consideration of the ensuing description and drawings.

DETAILED DESCRIPTION OF THE DRAWINGS

Figure 1:
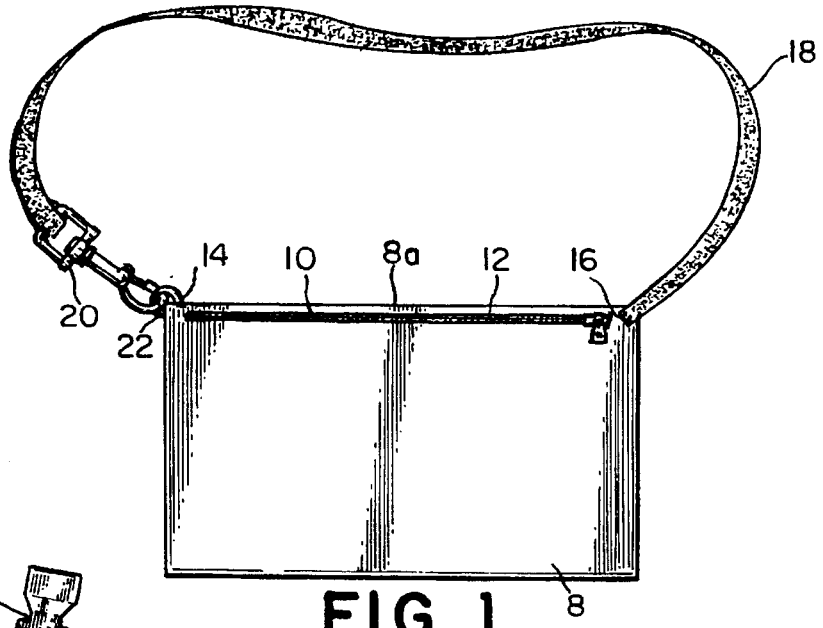
FIG. 1 is a perspective frontal view of a rectangular version of the waterproof swimming pouch constructed in accordance with the invention.

Turning to FIG. 1, enclosure 8 forms a jacket completely surrounding a waterproof resealable inner pouch liner (not shown). Enclosure 8 is formed in a rectangular shape, although any geometrical shape may be used. In the preferred embodiment, the enclosure is made of a woven fabric of a particular weave wherein the material can be cotton, nylon, polyester, or other known fabric materials. Opening 10 extends horizontally across the upper edge 8*a* of enclosure 8. Closure means 12, which in the preferred embodiment is a zipper, is fixed in opening 10 to enable opening and closing of opening 10. Snaps, buttons, or VELCRO (a trademark of VELCRO USA, Inc.) strips and other closing devices may be used as closure means 12.

Strap 18 may be made from any convenient strap material and is used to attach enclosure 8 around a wearer's waist. Strap 18 is attached to the right and left upper end portion of enclosure 8. In FIG. 1, the strap end 16 of strap 18 is sewn in place, although a buckle means may be used, and strap end 14 is attached to enclosure 8 by a 8 buckle 20 and eye 22. Buckle 20 and eye 22 interlock with one another to secure strap end 14 to enclosure 8, and may be disengaged from each other for detaching strap end 14 from enclosure 8. Buckle 20 and eye 22 can be made in a variety of different ways as will be obvious to persons skilled in the art and may be made from conventional materials such as plastic or metals.

Figure 2:
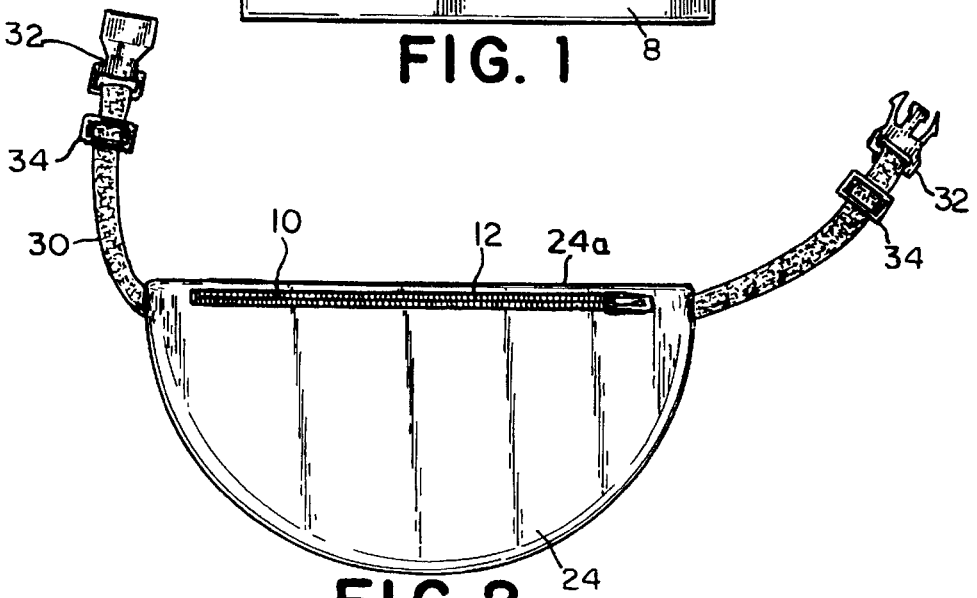
FIG. 2 is a perspective frontal view of a semicircular version of the waterproof swimming pouch constructed in accordance with the invention.

FIG. 2 shows enclosure 24 which forms a jacket completely surrounding a crescent-shaped waterproof inner pouch liner (not shown). Upper edge 24*a* of the enclosure 24 is shown with closure means 12 fixed in opening 10. Waist strap 30 is permanently attached to the enclosure left end portion and to the enclosure right end portion. The connector shown is a snap-type buckle 32 for securing the swimming pouch, and adjusters 34 are provided to allow the waist strap 30 to be shortened or lengthened. Enclosure 24 is formed in a crescent-shaped wedge, although any geometrical shape may be used.

Figure 3:
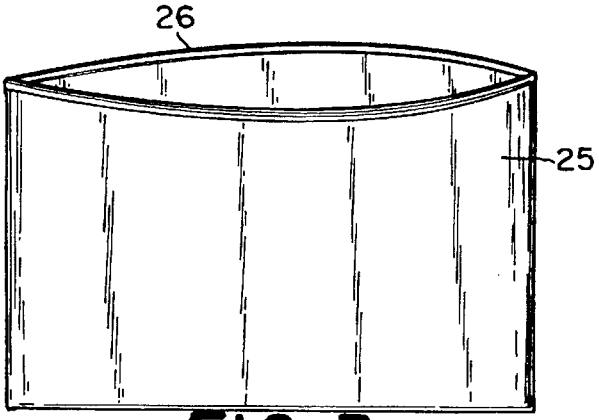
FIG. 3 is a view in perspective of a rectangular version of an inner pouch liner with resealable interlocking closure used in the waterproof swimming pouch of FIG. 1.

FIG. 3 shows an inner pouch liner 25, having a resealable interlocking closure 26. Waterproof enclosure 25 is formed in rectangular shape although any geometric shape may be used and is made of a durable waterproof plastic that has a resealable interlocking closure 26 generally known to those skilled in the art relating to closure fastening devices as demonstrated by the numerous patents in this area.

Figure 4:
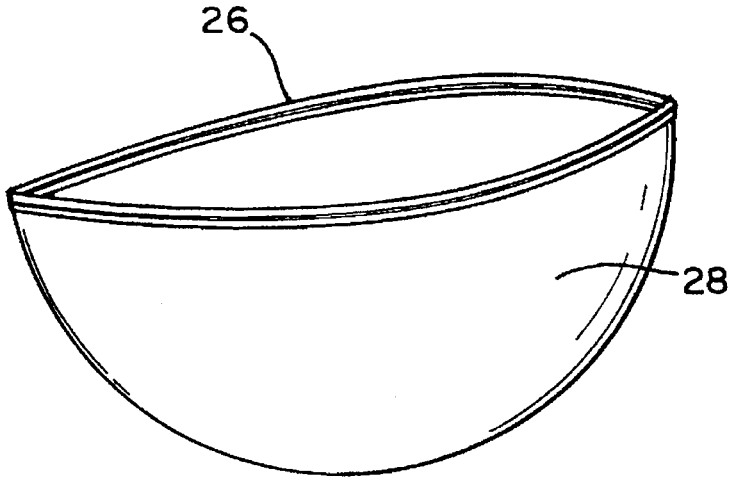
FIG. 4 is a view in perspective of a semicircular version of an inner pouch liner with resealable closure used in the waterproof pouch of FIG. 2.

FIG. 4 shows an alternative inner pouch liner 28. Enclosure 28 is formed in a crescent-shaped wedge shape, although any geometrical shape may be used, and is made of durable waterproof plastic that has resealable interlocking closure 26.

Figure 5:
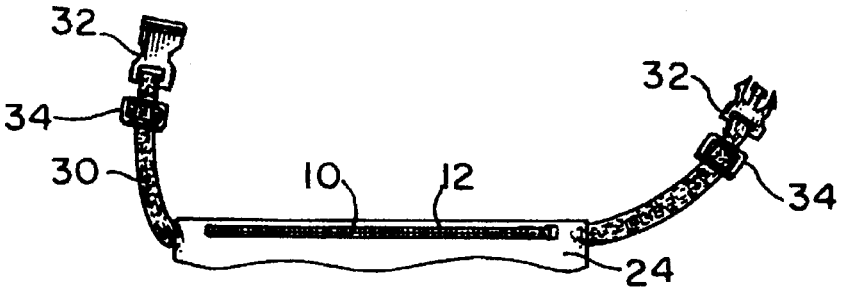
FIG. 5 is a frontal view of the upper edge portion of an inventive waterproof swimming pouch, showing the strap and connector.

FIG. 5 shows the upper edge portion of the enclosure 8, showing the fastener 12 in the form of a zipper and the strap 30 with snap-lock connectors 20, 22.

Figure 6:
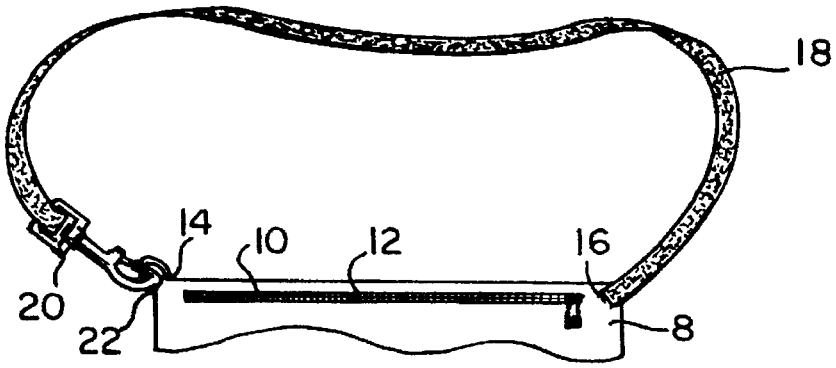
FIG. 6 is a frontal view of the upper edge portion of an inventive waterproof swimming pouch, showing an alternative strap and connector.

FIG. 6 is shows an alternative embodiment of the invention, with strap 18 being securely connected to the enclosure 8 by means of a spring-loaded swivel clip 20 and eye 22.

SUMMARY, RAMIFICATIONS, AND SCOPE

Accordingly the reader will see that the waterproof pouch allows the water sports enthusiast the freedom to enjoy their surroundings without the fear of losing or having stolen their personal belongings as well as having the additional advantages in that it permits the wearer to chose from a variety of types and colors of fabrics that are aesthetically appealing with swim wear;

it provides a lightweight enclosure;

it provides a non-breakable enclosure;

it provides an inexpensive and easy to use enclosure.

Although the description above contains many specifications, these should not be construed as limiting the scope of the invention but as merely providing illustrations of some of the preferred embodiments of this invention. For example, the enclosure can have other shapes, such as oval, circular, triangular, etc.; the enclosure can have other engagement means such as snaps, VELCRO ( a trademark of VELCRO USA, INC.) buttons, enclosure can be attached around user's waist by a thin nylon cord as well as a belt.

Thus the scope of the invention should be determined by the appended claims and their legal equivalents, rather than by the examples given.

What is claimed is:

1. A lightweight waterproof pouch for carrying personal objects in a wet environment and keeping those objects safe and dry, comprising an outer enclosure having a geometric shape and being of comfortable size formed of flexible material, the enclosure having an upper end portion, and first and second side portions, and a bottom portion, an opening formed in the upper end portion of the enclosure, outer enclosure closure means formed at the opening in the upper end portion of the outer enclosure for securely closing the opening when desired, a removable flaccid inner pouch liner for insertion into said enclosure, the inner pouch liner being formed of a waterproof flexible material and having an upper end portion, side portions, and a bottom portion, the inner pouch liner being shaped to fit the geometric shape of the enclosure without folding of the inner pouch liner, an opening in the upper end portion of the inner pouch liner, resealable inner pouch liner closure means formed at the opening in the inner pouch liner for closing the opening in the inner pouch liner when desired, for forming a watertight compartment inside the inner pouch liner, for keeping objects safe and dry, and a flexible strap mounted on the enclosure for holding the pouch around a wearer's body.

2. The pouch recited in claim 1 wherein the resealable inner pouch liner closure means closes the opening in the inner pouch liner independent of the outer enclosure closure means.

3. A lightweight waterproof pouch for carrying personal objects in a wet environment and keeping those objects safe and dry, comprising an outer enclosure having a geometric shape and being of comfortable size formed of flexible material, the enclosure having an upper end portion, and first and second side portions, and a bottom portion, an opening formed in the upper end portion of the enclosure, outer enclosure closure means formed at the opening in the upper end portion of the outer enclosure for securely closing the opening when desired, a removable flaccid inner pouch liner for insertion into said enclosure, the inner pouch liner being formed of a waterproof flexible material and having an upper end portion, side portions, and a bottom portion, the inner pouch liner being shaped to fit the geometric shape of the enclosure without folding of the inner pouch liner, an opening in the upper end portion of the inner pouch liner, resealable inner pouch liner closure means formed at the opening in the inner pouch liner for closing the opening in the inner pouch liner when desired, for forming a watertight compartment inside the inner pouch liner, and for keeping objects safe and dry, a flexible strap for holding the pouch around a wearer's body, the strap having a first end portion and a second end portion, connection means for connecting the first end portion of the strap to the first side portion of the enclosure, and connecting-disconnecting means mounted on the second end portion of the strap and the second side portion of the enclosure for connecting the second end portion of the strap to the second side portion of the enclosure when desired to secure the pouch around a wearer's waist and for disconnecting the second end portion of the strap from the second side portion of the enclosure when desired to permit the pouch to be removed from around the wearer's waist.

4. The pouch recited in claim 3 wherein the resealable inner pouch liner closure means closes the opening in the inner pouch independent of the outer enclosure closure means.

5. A lightweight waterproof pouch for carrying personal objects in a wet environment and keeping those objects safe and dry, comprising an outer enclosure having a geometric shape and being of comfortable size formed of flexible material, the enclosure having an upper end portion, and first and second side portions, and a bottom portion, an opening formed in the upper end portion of the enclosure, outer enclosure closure means formed at the opening in the upper end portion of the outer enclosure for securely closing the opening when desired, a removable flaccid inner pouch liner for insertion into said enclosure, the inner pouch liner being formed of a waterproof flexible material and having an upper end portion, side portions, and a bottom portion, the inner pouch liner being shaped to fit the geometric shape of the enclosure without folding of the inner pouch liner, an opening in the upper end portion of the inner pouch liner, resealable inner pouch liner closure means formed at the opening in the inner pouch liner for closing the opening in the inner pouch liner when desired, for forming a watertight compartment inside the inner pouch liner, and for keeping objects safe and dry, a flexible first strap for holding the pouch around a wearer's body, the first strap having a first end portion and a second end portion, connection means for connecting the first end portion of the first strap to the first side portion of the enclosure, a flexible second strap for holding the pouch around a wearer's body, the second strap having a first end portion and a second end portion, connection means for connecting the first end portion of the second strap to the second side portion of the enclosure, and connecting-disconnecting means mounted on the second end portion of the first strap and the second end portion of the second strap for connecting the second end portion of the first strap to the second end portion of the second strap when desired to secure the pouch around the wearer's waist and for disconnecting the second end portion of the first strap from the second end portion of the second strap when desired to permit the pouch to be removed from around a wearer's waist.

6. The pouch recited in claim 5 wherein the resealable inner pouch liner closure means closes the opening in the inner pouch liner independent of the outer enclosure closure means.

* * * * *